US006507249B1

(12) United States Patent
Schloemann

(10) Patent No.: US 6,507,249 B1
(45) Date of Patent: Jan. 14, 2003

(54) ISOLATOR FOR A BROAD FREQUENCY BAND WITH AT LEAST TWO MAGNETIC MATERIALS

(76) Inventor: Ernst F. R. A. Schloemann, 38 Brook Rd., Weston, MA (US) 02493-1713

( * ) Notice: Subject to any disclaimer, the term of this patent is extended or adjusted under 35 U.S.C. 154(b) by 10 days.

(21) Appl. No.: 09/388,336

(22) Filed: Sep. 1, 1999

(51) Int. Cl.[7] ..... H01P 1/387; H01P 1/36
(52) U.S. Cl. ..... 333/1.1; 333/24.2
(58) Field of Search ..... 33/1.1, 24.2

(56) References Cited

U.S. PATENT DOCUMENTS

| | | | | |
|---|---|---|---|---|
| 4,122,418 A | * | 10/1978 | Nagao | 333/1.1 |
| 4,390,853 A | | 6/1983 | Mathew et al. | 333/1.1 |
| 4,496,915 A | | 1/1985 | Mathew et al. | 333/1.1 |
| 4,789,844 A | | 12/1988 | Schloemann | 333/1.1 |
| 4,920,323 A | | 4/1990 | Schloemann et al. | 333/1.1 |

OTHER PUBLICATIONS

M. E. Hines, "Reciprocal and Nonreciprocal Modes of Propagation in Ferrite Stripline and Microstrip Devices", IEEE Trans. MTT–19, pp. 442–451, 1971.

H. Bosma, "On Stripline Y–Circulation at UHF", IEEE Trans, MTT–12, pp. 61–72, Jan. 1964.

Y. S. Wu and F. J. Rosenbaum, "Wideband Operation of Microstrip Circulators", IEEE Trans. MTT–22, pp. 849–856, Oct. 1974.

S. Ayter and Y. Ayasli, "The Frequency Behavior of Stripline Circulator Junctions", IEEE Trans. MTT–26, pp. 197–202, Mar. 1978.

E. Schloemann and R. E. Blight, "Broadband Stripline Circulators Based on YIG and Li–Ferrite Single Crystals", IEEE Trans. MTT–34, pp. 1394–1400, Dec. 1986.

E. Schloemann, "Circulators for Microwave and Millimeter Wave Circuits", Proc. IEEE, vol. 76, pp. 188–200, Feb. 1988.

R. E. Blight and E. Schloemann, "A Compact Broadband Microstrip Circulator for Phased Array Antenna Modules", IEEE MTT–S Digest, pp. 1389–1392, 1992.

R. I. Joseph and E. Schloemann, "Demagnetizing Field in Nonellipsoidal Bodies", J. Appl. Phys., vol. 36, pp. 1579–1593, 1965.

A. K. Ganguly and D. C. Webb, "Microstrip Excitation of Magnetostatic Surface Modes: Theory and Experiments", IEEE Trans. MTT–23, pp. 998–1006, 1975.

[13] E. Schloemann, "Miniature Circulators", IEEE Trans. on Magnetcs, vol. 25, No. 5 pp. 3236–3241, Sep. 1989.

* cited by examiner

*Primary Examiner*—Justin P. Bettendorf

(57) ABSTRACT

The performance of broadband isolators and circulators can be characterized by the ratio $f_{max}/f_{min}$, where $f_{min}$ and $f_{max}$ are defined as the edges of the frequency band in which the devices have acceptable operating characteristics. For the most advanced isolators and circulators available today this ratio is approximately 3:1. This invention teaches how to improve broadband performance substantially. The present limitations are shown to be primarily due to two causes: 1.) lack of bias field homogeneity, and 2.) previously unrecognized low-field loss due to excitation of magnetostatic surface waves. These surface waves are excited at the dielectric/ferrite interfaces on the side faces of the ferrite platelets or discs in the devices. For stripline edge-mode isolators and stripline circulators, the undesired low-field loss can be reduced by using certain rf device structures in combination with suitable bias magnets. These rf structures have a high-magnetization ferrite in the center region and lower-magnetization ferrites in the peripheral regions of the device. The bias magnets generally include high-permeability pole pieces, either in close proximity to the rf structure, or separated from it by composite pole shoes containing the same magnetic microwave materials inserted into the rf structure. It is estimated that $f_{max}/f_{min}$ ratios of about 6:1 are possible for properly designed devices using two microwave ferrites, whose saturation magnetizations are in the ratio of 2:1. Higher values of the $f_{max}/f_{min}$ ratio are possible when more than two microwave ferrites are used.

13 Claims, 9 Drawing Sheets

26
28
24
12
16
18a
18b
10a
10b
14a
14b
22a
22b
20a
20
22
20b
bias field direction
signal flow
20c
19b
19a
22c
14a
14b
12

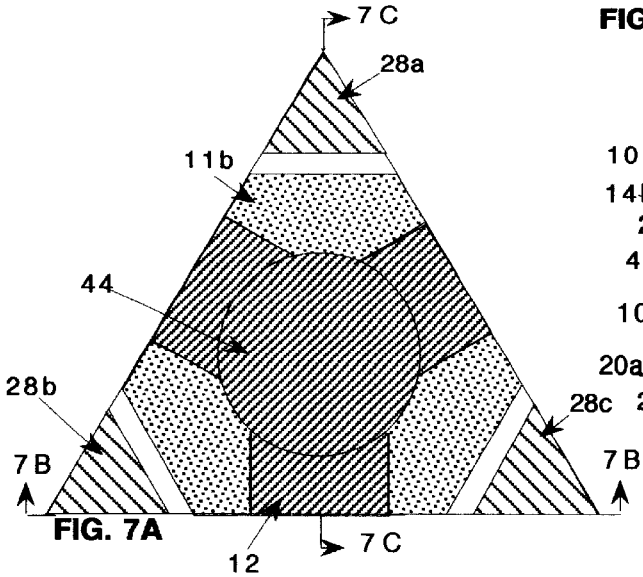
FIG. 7A
FIG. 7C
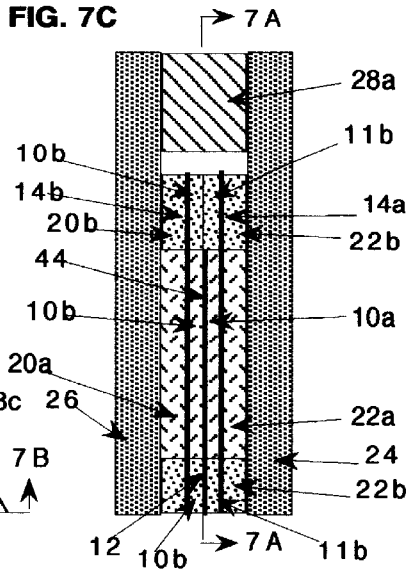
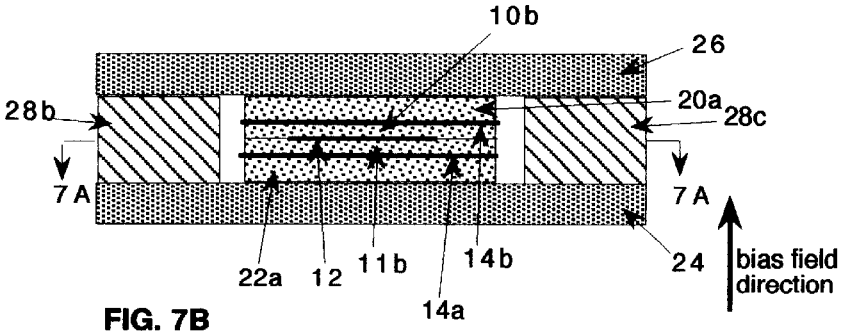
FIG. 7B

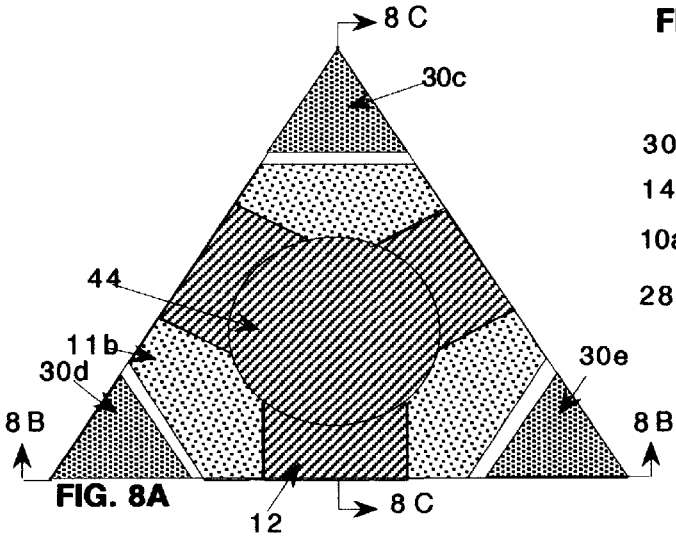
FIG. 8A
FIG. 8C
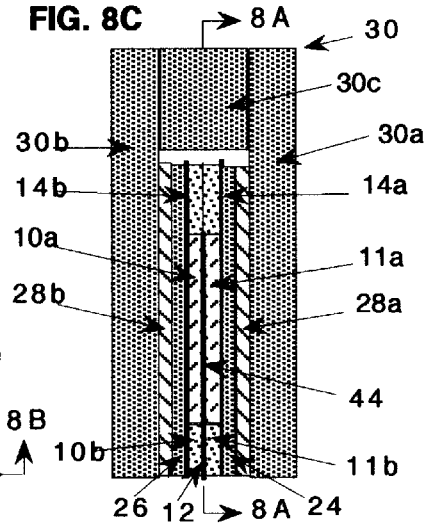
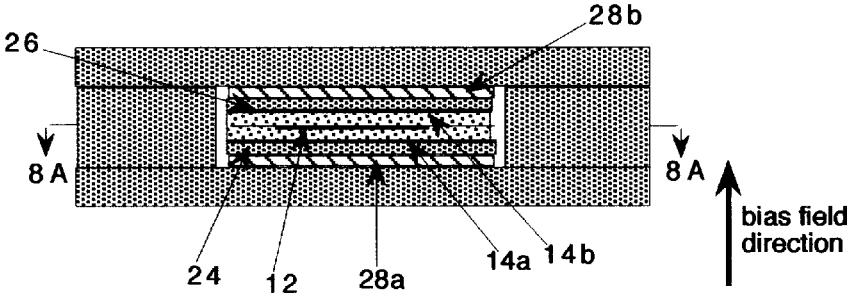
FIG. 8B

ISOLATOR FOR A BROAD FREQUENCY BAND WITH AT LEAST TWO MAGNETIC MATERIALS

BACKGROUND OF THE INVENTION

1. Introduction

This invention pertains generally to microwave devices, and more particularly to non-reciprocal microwave devices, such as isolators and circulators. Non-reciprocal microwave devices are based on electrically insulating magnetic materials, such as the materials generally known as "ferrites". Their performance can be characterized by the ratio $f_{max}/f_{min}$, where $f_{min}$ and $f_{max}$ are defined as the edges of the frequency band in which the devices have acceptable operating characteristics (typically less than 1 dB insertion loss and more than 15 dB isolation). For the most advanced isolators and circulators available today this ratio is approximately 3:1. The present invention shows how the broadband performance can be improved substantially.

For both isolators and circulators, the bandwidth that has been achieved in practice is generally much smaller than that predicted by the design theories that have been developed for these devices. One reason for the failure of these theories to account satisfactorily for the observed performance is that they assume that the microwave ferrite is in a very uniform magnetic bias field (internal field). Such a very uniform field is difficult to achieve in practice, and is not usually realized in typical isolators and circulators. Another reason is that the theories make no allowance for the excess low-field, low-frequency loss observed in these devices.

2. Review of the Microwave Properties of Magnetic Materials

The theoretical analysis of ferrite microwave devices is generally based on a "constitutive" equation, expressing the relation between rf magnetic flux b vector and rf magnetic field vector h by a tensor equation of the form $$b=\mu_0\bar{\mu}h. \tag{1}$$

Here $\mu_0$ is the permeability of vacuum and $\bar{\mu}$ the permeability tensor (permeability relative to vacuum)

$$\overleftrightarrow{\mu}=\begin{bmatrix}\mu & -j\kappa & 0\\ j\kappa & \mu & 0\\ 0 & 0 & \mu_z\end{bmatrix}. \tag{2}$$

Here the dc bias field is assumed to be applied in the z-direction and a time dependence proportional to exp(jωt) is implied, where ω=2πf and f is the signal frequency. The tensor components $\mu$ and κ can be calculated from the gyromagnetic equation of motion for the magnetization vector, with the result $$\mu-\kappa=1+f_M/(f_H-f)$$

$$\mu+\kappa=1+f_M/(f_H+f)$$

$$f_M=\mu_0\gamma M_s,\ f_H=\mu_0\gamma H_{int} \tag{3}$$

where γ is the gyromagnetic ratio, $M_s$ is the saturation magnetization and $H_{int}$ is the internal magnetic field. Losses can be taken into account by assigning an imaginary part $j\alpha_G f$ to the resonance frequency $f_H$, $\alpha_G$ being the so-called "Gilbert damping parameter".

The propagation of electromagnetic waves in an unbounded ferrite medium can easily be analyzed on the basis of Eqs. (1–3). Such an analysis shows that, in general, two types of waves or "wave modes" exist for any propagation direction. For propagation orthogonal to the bias field, one of the modes is characterized by an rf magnetic field in the z-direction and an effective permeability equal to $\mu_z$, whereas the other mode is characterized by an rf magnetic field having x- and y-components, and an effective permeability given by $$\mu_e=(\mu^2-\kappa^2)/\mu. \tag{4}$$

In the literature this scalar permeability is generally referred to as the "effective" permeability, and this custom is therefore also adopted in the present patent application. It plays an important role in the analysis of edge-mode isolators and stripline/microstrip circulators. It should be kept in mind, however, that the expression given in Eq. (4) generally does not represent an effective permeability for a guided wave in a ferrite substrate. From (3) and (4), the tensor components and the effective permeability can readily be shown to be $$\mu=[f_H(f_H+f_M)-f^2]/(f_H^2-f_H^2)$$

$$\kappa=-f_M f/(f_H-f^2)$$

$$\mu_e=[(f_H+f_M)^2-f^2]/[f_H(f_H+f_M)-f^2] \tag{5}$$

In the analysis of broadband isolators and circulators, the case in which $f_H$ is very small compared to $f_M$ and f is of special significance. If damping is neglected, Eq. (5) easily reduces to $$\mu=1$$

$$\kappa=f_M/f$$

$$\mu_e=1-(f_M/f)^2 \tag{6}$$

under these conditions, which implies that $\mu_e$ is negative for frequencies less than $f_M$.

3. Broadband Isolators

The most successful broadband isolators currently available are based on the edge-mode configuration, described in a paper entitled "Reciprocal and Nonreciprocal Modes of Propagation in Ferrite Stripline and =Microstrip Devices" by M. E. Hines [IEEE Trans. MTT-19, pp. 442–451, 1971]. These devices typically include a stripline or microstrip line on a ferrite substrate, which is magnetized normal to its plane. A sheet of resistive material with a predetermined surface resistance is located along the side of the strip conductor, in a plane orthogonal to the strip conductor. Hines describes a simple approximate analysis, which applies to this structure if the strip conductor is much wider than the substrate thickness. Under these conditions, the actual boundary conditions that exist at the edge of the strip conductor can be replaced by so-called "magnetic wall" boundary conditions by way of approximation. This approximate procedure may be justified by the observation that any electric current in the strip conductor can not flow orthogonal to the edge, and hence cannot induce a magnetic field component parallel to the strip conductor. For magnetic wall boundary conditions, the field equations can be solved exactly and simply, as shown by Hines. His analysis shows that the fundamental mode of this structure, with the resistive plane removed, consists of a wave that propagates parallel to the strip conductor and varies exponentially in the transverse direction. Thus the energy carried by the wave is displaced predominantly to one side of the strip conductor. The dispersion relation for these waves can be characterized by a scalar permeability, which turns out to be equal to the diagonal component of the permeability tensor, not the effective permeability of Eq. (4).

The effect of the resistive layer on the propagation characteristics of the edge-mode isolator has also been analyzed by Hines. Because of the field displacement effect mentioned above, the attenuation depends on the direction of propagation. The presence of a resistive layer with a given surface resistance (ohm per square) can be taken into account by imposing the appropriate transverse impedance condition on the rf field. The resultant characteristic equation for the complex propagation constant $\beta$ as a function of frequency $\omega$ can be expressed as $F(\beta,\omega)=0$, where F is a relatively simple transcendental function that depends on all relevant device parameters. Solutions for the propagation constant can be constructed by Newton's method for both directions of propagation, and for the dominant mode as well as any higher-order mode. Hines has reported the results of such calculation, taking only the losses due to the resistive layer into account and assuming a homogeneous bias field. The difference in the attenuation constants can be very large when the strip conductor is sufficiently wide.

Hines has also pointed out that, on the basis of the theory he developed, one might expect the edge-mode circulator to work over a virtually unlimited bandwidth if the ferrite is biased to saturation and the internal magnetic bias field is suitably small. In his experiments he obtained a frequency ratio $f_{max}/f_{min}$ of about 2:1, which was considered very good at the time. Later investigators have improved the bandwidth somewhat and have achieved $f_{max}/f_{min}$ of approx. 3:1. The discrepancy between the theoretically expected bandwidth and that obtained in practice has traditionally been attributed to "low-field loss", but the exact nature of this loss has remained mysterious. It is well known that unmagnetized and partially magnetized ferrite materials are very lossy when the signal frequency f is less than the characteristic frequency $f_M$ defined in Eq. (3), i. e. for $$f \leqq f_M. \tag{7}$$

This behavior can be explained by noting that, in magnetic materials that contain domains of opposite polarity, an unusual type of ferromagnetic resonance can occur. But this mechanism does not apply to a magnetically saturated ferrite, and hence does not actually explain the low-field loss observed in the edge-mode isolators.

4. Broadband Circulators

Broadband circulators are usually based on the stripline or the microstrip configuration. The stripline version typically includes a symmetric three-way junction of strip conductors connected to a central metal disk and sandwiched between ferrite substrates or substrates that are part ferrite part dielectric. In either case, the substrates are magnetized orthogonal to their plane. The volume underneath and above the central metal disk is generally occupied by ferrite, but the ferrite may extend further out from the junction center. As first pointed out in a paper entitled "On Stripline Y-Circulation at UHF" by H. Bosma [IEEE Trans, MTT-12, pp. 61–72, January 1964], this structure can be conveniently analyzed by introducing a Green's function $G(r,\phi;R,\phi')$ that relates the axial component of the electrical field $e_z(r,\phi)$ at an arbitrary point $(r,\phi)$ within the ferrite disc to the circumferential component of magnetic field $h_\phi(R,\phi')$ at the periphery $(R,\phi')$ of the disk. The Green's function is derived from Maxwell's equations for the region occupied by the ferrite, in which the rf permeability has the form given in Eqs. (1) and (2). The scattering matrix of the circulator can then be calculated, using the assumption that the circumferential component of magnetic field is zero along the periphery of the disk, except where it is connected to the strip conductors. In the latter regions the rf magnetic field is determined by the incoming and outgoing electromagnetic waves.

The broadband circulator analysis based on Bosma's approach was further developed in the paper entitled "Wideband Operation of Microstrip Circulators" by Y. S. Wu and F. J. Rosenbaum [IEEE Trans. MTT-22, pp. 849–856, October 1974] and the paper entitled "The Frequency Behavior of Stripline Circulator Junctions" by S. Ayter and Y. Ayasli [IEEE Trans. MTT-26, pp. 197–202, March 1978]. The theory was at first developed only for the frequency range in which $\mu_e$ is positive. The $f_{max}/f_{min}$ ratio for circulators, obtainable by this approach, is approx. 2:1. Circulator operation in the frequency range in which $\mu_e$ is negative was apparently considered impossible, because the Green's function and the scattering matrix derived from it are represented by algebraic expressions that involve $\sqrt{\mu_e}$, and hence appear to become very singular in the limit of very small $\mu_e$. It is now known, however, that the apparent singularity of the Green's function is quite harmless, because the vanishing denominators are all canceled by vanishing numerators, as shown in the paper entitled "Broadband Stripline Circulators Based on YIG and Li-Ferrite Single Crystals" by E. Schloemann and R. E. Blight [IEEE Trans. NM-34, pp. 1394–1400, December 1986]. Thus the theoretical expressions derived by Bosma, and Wu/Rosenbaum remain valid when $\mu_e$ approaches zero and then becomes negative, except that the Bessel functions that occur in these expressions must now be interpreted as functions of a complex variable. For the lossless case this means that, for each order n, the Bessel function $J_n$ is replaced by the modified Bessel function $I_n$ in the manner detailed by Schloemann and Blight. The physical significance of resonant modes for $\mu_e<0$ is that for these modes the excitation is large near the surface and decays toward the interior, whereas for $\mu_e>0$ the modes have an oscillatory behavior in the radial direction.

With suitably chosen design parameters (such as disk diameter, saturation magnetization, bias field, and the characteristic impedance of the transmission lines connected to the junction) the theoretically expected performance of broadband circulators according to the revised theory described by Schloemann/Blight and in the paper entitled "Circulators for Microwave and Millimeter Wave Circuits" by Schloemann [Proc. IEEE, Vol. 76, pp. 188–200, February 1988] is much better than that to be expected according to the earlier calculations of Bosma, Wu/Rosenberg and Ayter/Ayasli. This may be seen from FIG. 2 of the Schloemann/Blight publication and FIG. 5 of the last quoted Schloemann publication. These figures show that the analysed circulators, when connected to transmission lines having a suitably low characteristic impedance, would have acceptable performance over a band stretching from about 0.5 GHz to 10 GHz (for the Schloemann/Blight reference) or 17 GHz (for the Schloemann reference). However, as in the case of broadband edge-mode isolators, this ideal behavior again is not observed in practical devices.

In the experimental work reported in the preceeding two references, a concerted effort was made to generate a homogeneous internal magnetic bias field, by means of hemispherical pole caps positioned outside the stripline device.

The results showed that low-loss circulator operation was indeed achievable in the frequency range $0.5\ f_M<f<2f_M$, but that for $f<0.5f_M$ some additional losses were present that could not readily be explained.

An alternative approach toward improving the broadband performance of circulators is to position a ring of a secondary ferrite having a lower saturation magnetization around the primary ferrite, which is at the junction center. This approach, which may be used for microstrip as well as for stripline circulators, has been described by M. G. Matthew and T. J. Weisz in the U.S. patents entitled "Microwave Transmission Devices Comprising Gyromagnetic Material Having Smoothly Varying Saturation Magnetization", [U.S. Pat. No. 4,390,853] and "Microwave Transmission Devices Having Gyromagnetic Materials Having Different Saturation Magnetizations"[U.S. Pat. Nos. 4,496,915], and by R. Blight and E. Schloemann in the paper entitled "A Compact Broadband Microstrip Circulator for Phased Array Antenna Modules" [IEEE MTT-S Digest, pp. 1389–1392, 1992]. It has led to the development of useful broad band chculators with an $f_{max}/f_{min}$ ratio of about 3.

BRIEF SUMMARY OF THE INVENTION

The performance of broadband non-reciprocal microwave devices (isolators and circulators), expressed as the frequency ratio $f_{max}/f_{min}$, is presently limited by the combination of inhomogeneity of the internal bias field and a universal low-field, low-frequency loss component. Unlike other types of low-field loss, this component occurs in fully saturated magnetic matials, and generally increases the insertion loss of ferrite microwave devices below a characteristic frequency. Formerly unexplained, this loss is now interpreted as arising from the excitation of magnetostatic surface waves (MSSWs) at the perimeter of the ferrite disc, as discussed in more detail in the Detailed Description of the Invention. According to the present invention, the MSSW-related loss can be shifted out of the desired performance band of the device by maintaining a homogeneous internal magnetic bias field, and by using a multiplicity of magnetic materials, arranged in a sequence, such that the material having the highest magnetization is at or near the center of the device and materials with progressively lower magnetizations are further away from the center.

In a first preferred embodiment, these materials are placed inside the microwave transmission structure, and high-permeability pole pieces are placed adjacent to the thin conductive envelop of the microwave transmission structure as part of the magnetic bias circuit. In a second preferred embodiment, the magnetic materials having different saturation magnetizations are placed inside the microwave transmission structure, and also outside the microwave transmission structure. In this embodiment, composite pole shoes of the magnetic materials having different saturation magnetizations are placed between the thin conductive envelop of the microwave transmission structure and the high-permeability pole pieces, as part of the magnetic bias circuit. The purpose of the composite magnetic pole shoes is to improve the homogeneity of the internal magnetic bias field, to which the pieces of magnetic material inside the microwave transmission line are exposed. This bias field is adjusted to have a suitably small value.

In accordance with the present invention, a broadband non-reciprocal microwave device includes a multi-port transmission line structure that contains a multiplicity of magnetic materials interior to its conductive envelop; arranged in a sequence, such that the material having the highest magnetization is at or near the center of the device and materials with progressively lower magnetizations are further away from the center. The microwave device further includes a magnetic bias circuit designed to generate a homogeneous internal magnetic field inside each of the magnetic materials, this magnetic field being very small compared to the smallest saturation magnetization.

In accordance with a further aspect of the present invention, a broadband non-reciprocal microwave device includes facilities for providing isolator action in a two-port transmission line that contains at least two magnetic materials interior to its conductive envelop. The magnetic materials are arranged in a sequence, such that the material having the highest magnetization is at or near the center of the device, and materials with progressively lower magnetizations are further away from the center. The facilities for providing isolator action further include a resistive sheet of material with a predetermined surface resistance disposed along the microwave transmission line in an off-center position, and a magnetic bias circuit designed to generate a uniform internal magnetic field inside each of the magnetic materials, this magnetic field being very small compared to the smallest saturation magnetization.

In accordance with a further aspect of the present invention, a broadband non-reciprocal microwave device includes facilities for providing circulator action in a three-port transmission line structure that contains at least two magnetic materials interior to its conductive envelop arranged in a sequence, such that the material having the highest magnetization is at or near the center of the device, and materials with progressively lower magnetizations are further away from the center. The facilities for providing circulator action further include a magnetic bias circuit designed to generate a uniform internal magnetic field inside each of the magnetic materials, this magnetic field being very small compared to the smallest saturation magnetization.

BRIEF DESCRIPTION OF THE DRAWINGS

FIGS. 7A, 7B and 7C show three orthogonal cross sections through a first embodiment of a broadband circulator.

FIGS. 8A, 8B and 8C show three orthogonal cross sections through a second embodiment of a broadband circulator.

DETAILED DESCRIPTION OF THE INVENTION, PREFERRED EMBODIMENTS

1. Stripline Isolators

Figures 1, 1A:
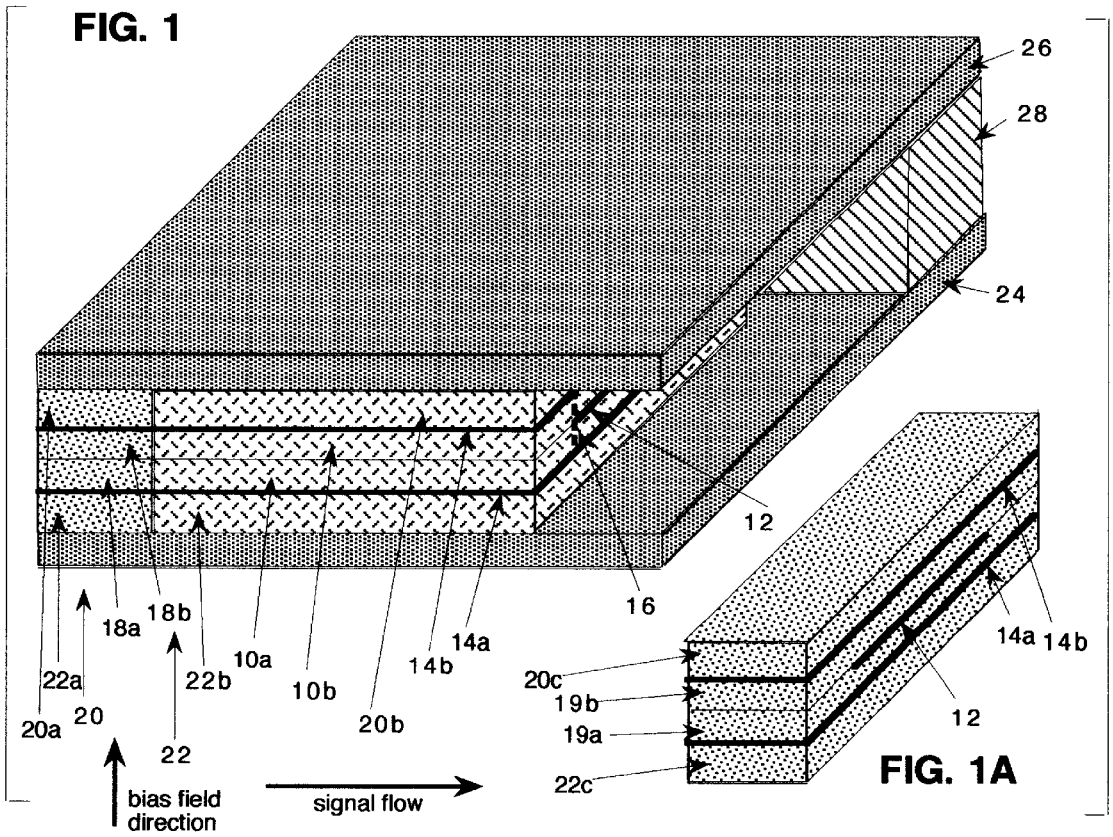
FIGS. 1 and 1A show a perspective, exploded view of a first embodiment of a broadband edge-mode isolator.

Referring to FIGS. 1 and 1A, a broadband isolator includes a transmission line structure comprising two ferrite platelets 10*a* and 10*b* that are magnetized normal to their plane, a wide conductive strip 12 located between the two ferrite platelets, two ground planes 14*a* and 14*b*, and a resistive sheet 16 that is positioned along the side of the conductive strip in a plane orthogonal to the conductive strip. The broadband isolator shown in FIGS. 1 and 1A also comprises two additional pairs of ferrite platelets 18*a*, 18*b* and 19*a*, 19*b* positioned between the two ground planes at the input and output ports of the device. The saturation magnetization of these platelets is approximately half as large as that of the platelets 10*a* and 10*b*. Furthermore, the device shown in FIG. 1 comprises two composite magnetic pole shoes 20 and 22 containing, in the portion adjacent to the microwave transmission line structure, a sequence of individual magnetic pole shoes 20*a*, 20*b*, 20*c* and 22*a*, 22*b*, 22*c* having a magnetization of the same magnitude as the magnetic material disposed adjacent to it in the interior of the microwave transmission line structure, two high-permeability magnetic pole pieces 24 and 26 placed adjacent to the composite pole shoes at a minimum separation, and a block of permanent magnet material 28. The purpose of the additional ferrite platelets is to 1.) assure near-perfect homogeneity of the internal bias field and 2.) to eliminate excitation of magnetostatic surface waves (MSSWs) from the desired frequency band.

In the structure illustrated in FIGS. 1 and 1A, surface waves can occur at the surfaces of the low-magnetization ferrite and interface waves at the interfaces of high-magnetization and low-magnetization ferrites. Consider now the propagation of a magnetostatic interface wave along the boundary between two magnetic materials, with the bias field parallel to the interface, and the propagation direction orthogonal to the bias field. A simple analysis shows that, in the ideal case of wide ferrite platelets and assuming equal polarity of the dc magnetizations, the frequency of the interface wave is given by $$f=\mu_0\gamma H_{int}+\tfrac{1}{2}(f_M-f_M). \tag{8}$$

Similarly, the frequency of the surface wave at the ferrite/dielectric interface is given by $$f=\mu_0\gamma H_{int}+\tfrac{1}{2}f_{M2}. \tag{9}$$

Here $f_M$ and $f_{M2}$ are, respectively, the characteristic frequencies (see third line of Eq.(3))
corresponding to the higher and lower saturation magnetization. If we now choose $$f_{M2}=\tfrac{1}{2}f_M \tag{10}$$

the frequency of surface waves at the ferrite-ferrite interface and at the outer ferrite-dielectric interface both become $$f=\mu_0\gamma H_{int}+\tfrac{1}{4}f_M. \tag{11}$$

Thus low-field loss has been eliminated, except in the frequency range, in which $$f\geqq\tfrac{1}{4}f_M. \tag{12}$$

In the early work on edge-mode isolators (Hines 1971) the ferrite platelets were placed in a fairly large bias magnet, having a homogeneous external magnetic field. It is important to realize that homogeneity of the external field does not guarantee homogeneity of the internal field, since the demagnetizing field is strongly inhomogeneous for non-ellipsoidal sample shape. In their paper entitled "Demagnetizing Field in Nonellipsoidal Bodies" R. I. Joseph and E. Schloemann [J. Appl. Phys. , Vol. 36, pp. 1579–1593, 1965] have derived analytic expressions for the local fields in rectangular parallelepipeds and circular cylinders. For the sample shape used in Hines's experiments, the demagnetizing field calculated from these analytic expressions is about half as large at the perimeter of the platelet as it is at the center. If the sample is placed in a homogeneous external bias field, and the field strength is adjusted such that the internal bias field is substantially zero at the center, the internal field at the perimeter will be approx. $M_s/2$. This large amount of field variation has a very significant effect on the performance of the edge-mode isolator. When the analysis of MSSW excitation given above is applied to the device configuration used in Hines's experiments it leads to the conclusion that loss due to MSSW excitation should occur at frequencies less than $f_M$, in agreement with the experimental observation described by Hines.

In their paper entitled "Microstrip Excitation of Magnetostatic Surface Modes: Theory and Experiments" A. K. Ganguly and D. C. Webb [IEEE Trans. MTT-23, pp. 998–1006, 1975] have provided a detailed analysis of the MSSW excitation process for the case in which the bias field is applied parallel to a strip conductor on a ferrite film, deposited on a dielectric substrate. They have calculated the energy loss due to radiation, and have expressed it in terms of a "radiation resistance". The Ganguly/Webb analysis is not directly applicable to the edge-mode isolator, because it is based on a different device structure. Even though a similar analysis that is directly applicable to broadband isolators has not yet been carried out, it appears very likely that this radiation loss largely determines the low-frequency insertion loss of these devices.

Experience has shown (Hines 1971) that the upper limit of the performance band of edge-mode isolators is substantially given by $2f_M$. With the lower limit of the band now defined by Eq. (12), the ideally achievable $f_{max}/f_{min}$ ratio for the dual-ferrite configuration illustrated in FIG. 1 is calculated to be 8:1. This estimate is based on the assumption of ideal conditions that are not likely to be realizable in practice. The practically achievable $f_{max}/f_{min}$ ratio for the dual-ferrite structure may be closer to 6:1.

Higher values of the $f_{max}/f_{min}$ ratio are possible when more than two microwave ferrites are used. The analysis given above can be extended and applied to isolators containing three different ferrites. In this case, the best broadband performance is obtained when the three saturation magnetizations are in the ratio 3:2:1. The ideally achievable $f_{max}/f_{min}$ ratio is found to be 12:1 under these conditions.

The structure illustrated in FIGS. 1 and 1A is capable of providing isolator action over a very broad bandwidth, but has the disadvantage that the bias field depends sensitively on the location of any high-permeability materials in its vicinity, in particularly when such materials become accidentally attached to the biasing magnet.

Referring to FIGS. 2A, 2B, 2C and 3A, 3B, 3C two alternative bias structures for edge-mode isolators are shown, which overcome this disadvantage. They are shown in the form of three orthogonal cross sections. The embodiments shown in FIGS. 2A to 3C are comprised of several different materials, which may be identified by reference to FIG. 2D. The "Type 1" version shown in FIGS. 2A, 2B, 2C comprises a rectangular flux yoke of magnetically "soft" (high permeability) material 30, two permanent magnet platelets 28*a* and 28*b*, the transmission line structure of the isolator, and two high-permeability pole pieces 24 and 26, which are placed immediately adjacent to microwave transmission line structure at a minimum separation from the magnetic material in the interior of this transmission line structure. The rectangular flux yoke 30 comprises four individual pieces 30*a*, 30*b*, 30*c* and 30*d*. The transmission line structure of the device shown in FIGS. 2A–2C comprises the same parts as that of the device shown in FIGS. 1 and 1A.

Figure 2A:
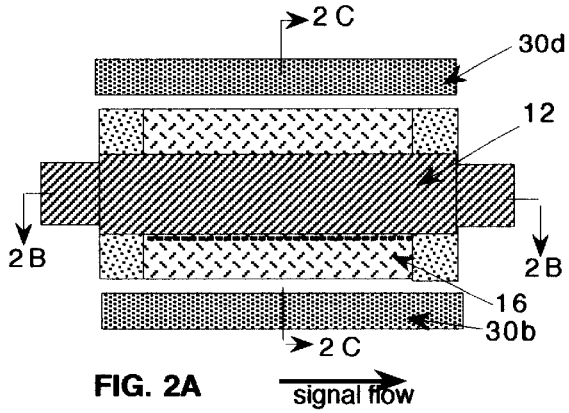
FIGS. 2A, 2B and 2C show three orthogonal cross sections through a second embodiment of a broadband edge-mode isolator, having a bias magnet configuration denoted as "Type 1".
Figure 2B:
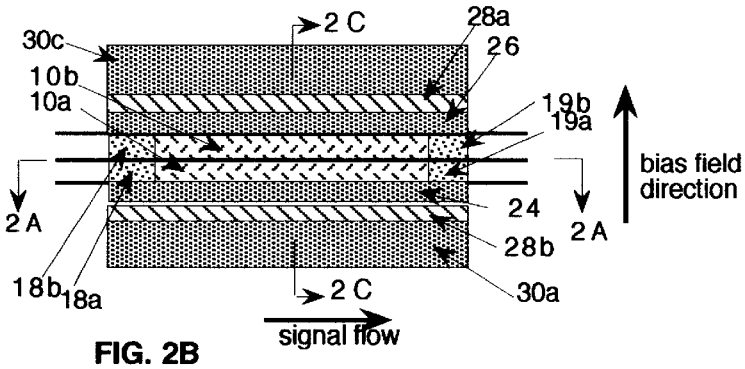
Figure 2C:
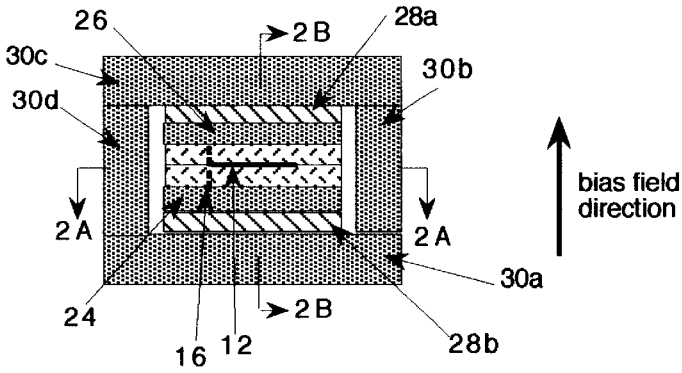
Figure 2D:
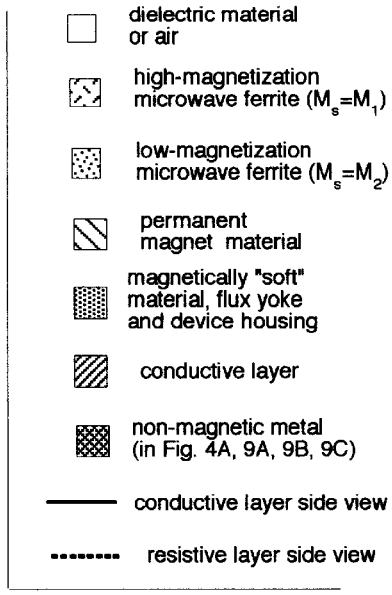
FIG. 2D shows several surface patterns that are used in FIGS. 2A, 2B, 2C, 3A, 3B, 3C, 4A, 4B, 4C, 7A, 7B, 7C, 8A, 8B, 8C, 9A, 9B and 9C to identify the materials contained in the various structures.
Figure 3A:
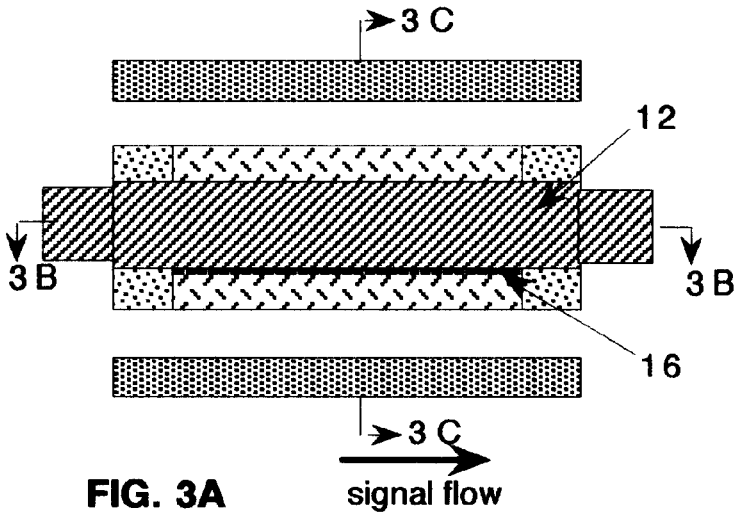
FIGS. 3A, 3B and 3C show three orthogonal cross sections through a third embodiment of a broadband edge-mode isolator, having a bias magnet configuration denoted as "Type 2".
Figure 3B:
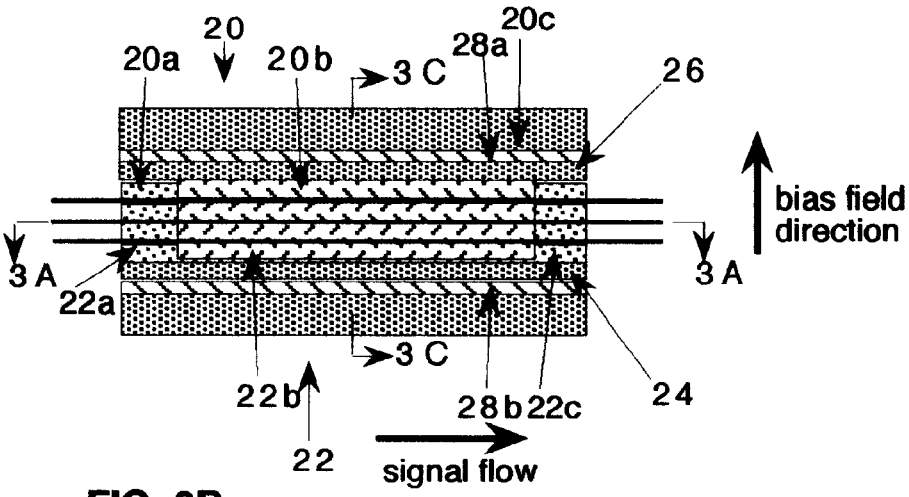
Figure 3C:
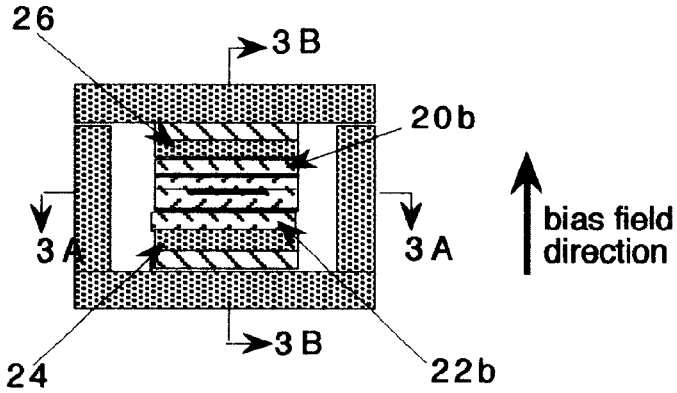

The "Type 2" version shown in FIGS. 3A, 3B, 3C is similar to the Type 1 version of FIGS. 2A, 2B, 2C, except that composite pole shoes 20 and 22 comprising platelets of the microwave ferrite (or a magnetic material having the same satuation magnetization) are positioned between the rf structure and the high-permeability pole pieces 24 and 26. In both of the structures shown in FIGS. 2A, 2B, 2C and 3A, 3B, 3C only one of the two magnets is essential. However, the use of two magnets instead of one is likely to improve field homogeneity, and hence isolator performance.

The flux yokes 30 illustrated in FIGS. 2A, 2B, 2C and 3A, 3B, 3C also serve as a housing or cover for the device. If their thickness is sufficient to accommodate the magnetic flux that permeates the microwave ferrite, the magnetic flux will be confined to the interior of the device, and the device is shielded from external magnetic fields. The high-permeability pole pieces 24 and 26 of FIGS. 2A, 2B, 2C and 3A, 3B, 3C have the effect of equalizing the magnetic bias field in the microwave ferrite, i.e. making the internal magnetic field nearly homogeneous. For a pole piece of infinite permeability the magnetostatic potential has the same value at any point of its surface. This implies that, in the absence of any gap between pole piece 24 and the microwave ferrite, and between pole piece 26 and the microwave ferrite, the internal magnetic field would be homogeneous. In practice, however, a small gap between each pole piece 24 or 26 and the microwave ferrite can not be avoided, because a conductive ground plane is required in order to confine the rf electromagnetic fields to the interior of the device. The thickness of the ground planes has to be larger than a few times the electromagnetic skin depth, which implies a minimum ground-plane thickness of about 1 micrometer. Although this gap length is very small compared to the device thickness, it will introduce an inhomogeneity of the internal magnetic field and thus lead to some performance deterioration. Additional field inhomogeneity is likely to be induced by the fact that the pole-piece permeability, though high, is not infinite. The effect of these factors on the homogeneity of the internal magnetic field, and hence on device performance, can be alleviated by using a bias magnet configuration such as shown in FIGS. 3A, 3B, 3C.

Figure 4A:
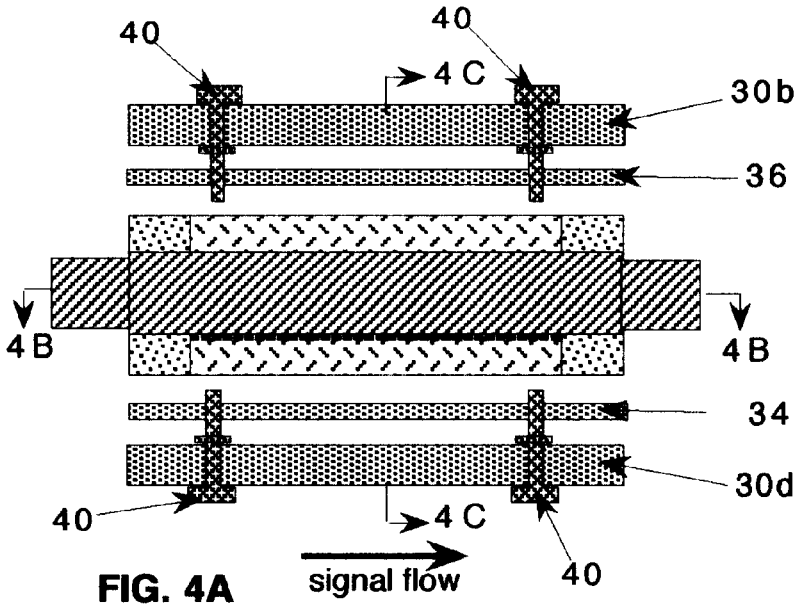
FIGS. 4A, 4B and 4C show three orthogonal cross sections through a fourth embodiment of a broadband edge-mode isolator, having a Type 2 bias magnet configuration.
Figure 4B:
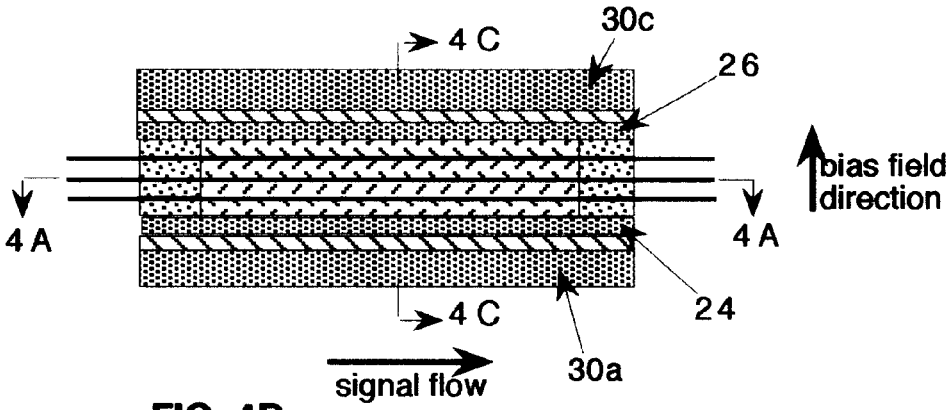
Figure 4C:
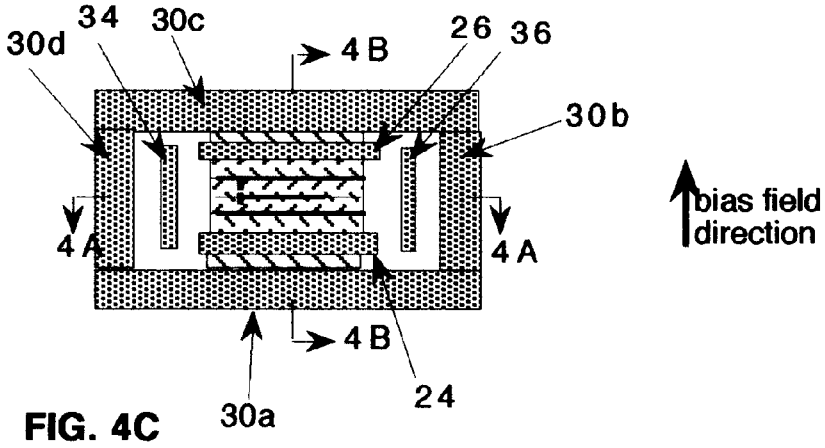

The theoretical analysis of edge-mode isolators indicates that the best broadband performance will be obtained at small bias field values. It is therefore important to configure the device in such a manner that the bias field can be adjusted after the device has been fully assembled. This desirable feature is facilitated by the structure shown in FIGS. 4A, 4B, 4C. Tunability is achieved by incorporating two magnetic shunts 34 and 36 in the bias structure. Each shunt is held in position by two tuning screws 40 that are rotatably mounted on the two side walls 30*b* and 30*d* of the device. Each screw engages a thread in one of the magnetic shunts 34 and 36. The largest bias field value will be realized when the shunts are furthest removed from the high-permeability pole pieces 24 and 26. When the shunts 34 and 36 are in contact with the pole pieces 24 and 26, substantially all magnetic flux generated by the bias magnets goes through the shunts, which implies that the microwave ferrite inside the transmission line structure becomes demagnetized. Optimal performance is expected somewhere between these extremes. It should be noted that, in order to keep the two shunts 34 and 36 in proper alignment with the two pole pieces 24 and 26, the four tuning screws 40 should always be turned by the same amount relative to an aligned starting position (such as one of the extreme positions mentioned above). This can be facilitated by means of a mechanical tuning fixture, into which the fully assembled isolators may be inserted for final adjustment.

It should be noted that the edge-mode isolators shown in FIGS. 1 to 4C require input and output lines of relatively low characteristic impedance to achieve their potential as a broadband device. Matching sections, which are not shown in these illustrations, are needed if the device is to be connected to striplines having 50 Ohm characteristic impedance.

Figure 5:
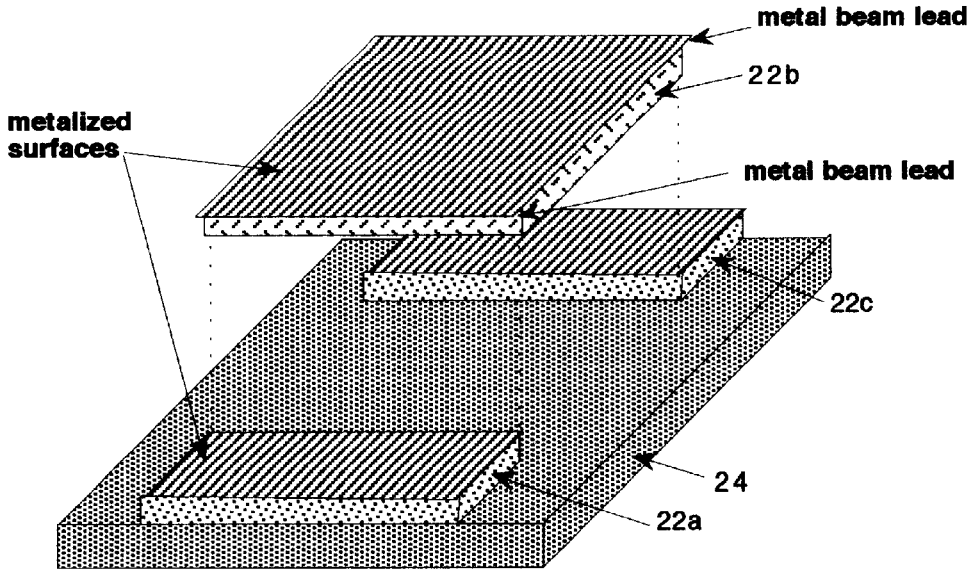
FIGS. 5 and 6 illustrate a process used to fabricate edge-mode isolators of the kind illustrated in FIGS. 1, 3A, 3B, 3C, 4A, 4B and 4C.
Figure 6:
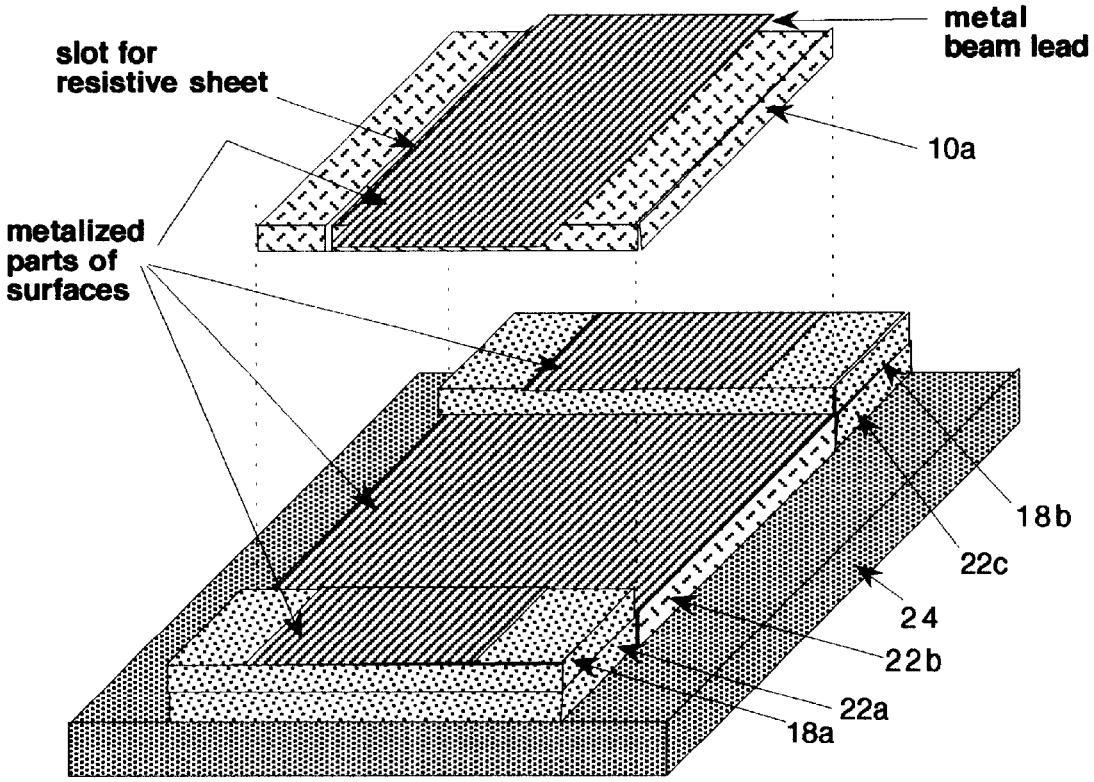

It may be questioned that a structure such as shown in FIGS. 1–4C can be reproducibly manufactured at low cost. In particular, it may appear difficult to maintain good electrical contact between the metalized areas of adjacent substrate. A possible solution would be to use ferrite platelets without metalized surfaces and place thin sheets of conductive material, properly shaped to form the ground planes and the strip conductor, between layers of ferrite platelets. The thin sheets of conductive materials would bridge the narrow gaps between adjacent platelets. This approach, though feasible, has the disadvantage of introducing relatively large gaps into the magnetic circuit, which leads to an undesirable field inhomogeneity. To address these concerns, FIGS. 5 and 6 illustrate a fabrication technique that uses metalized ferrite platelets with the metalization extending beyond the edge of the ferrite platelet in the desired locations. The flaps of metalization that extend beyond the edge of the platelet are generally known as "beam leads". The application of this method to circulator fabrication has previously been discussed in the paper entitled "Miniature Circulators" by E. Schloemann [IEEE Trans. MAG-25, pp. 3236–3241, September 1989], and in the patent entitled "Miniature Circulators for Monolithic Microwave Integrated Circuits" [U.S. Pat. No. 4,920,323, April 24, 1990].

FIG. 5 illustrates how two metalized platelets of low-magnetization ferrite are initially positioned on the base plate of the isolator. A metalized platelet of high-magnetization ferrite with attached "beamnleads" is then inserted between them and the metalizations are connected by soldering. This establishes one of the two ground planes of the stripline structure shown in FIGS. 1, 1A, 3A–4C.

FIG. 6 illustrates a further step in the assembly of an edge-mode isolator of the type shown in FIGS. 1–4C. Two additional platelets of low-magnetization ferrite are positioned on the ground plane established in FIG. 5. Both of these platelets carry a metalization that is patterned to form the strip conductor of a transmission line. Two rectangular platelets of high-magnetization ferrite are then inserted between them. One of these also carries a metalization that is patterned to form the strip conductor of a transmission line, whereas the other is positioned such as to leave a narrow slot along the strip conductor for the insertion of a sheet of resistive material with a predetermined surface resistance. The metalizations are then connected by soldering. The two additional layers of ferrite substrates needed to complete the structure can then be added using the same technique. With minor modifications, this method of fabrication is also applicable to the edge-mode isolator illustrated in FIGS. 2A–2C.

2. Stripline Circulators

The bandwidth limitations of junction circulators due to MSSW excitation, described in the section entitled "Background of the Invention", can be overcome by surrounding the magnetic material at the junction center with a magnetic material having a lower saturation magnetization, provided that a highly homogeneous internal magnetic bias field is maintained. This can be done by placing high-permeability pole pieces in close proximity of the microwave ferrite materials on both sides of the device. In this configuration, the microwave ferrite materials are separated from the high-permeability pole pieces only by very thin electrical ground planes. Improved field homogeneity can be obtained by inserting an additional layer of microwave ferrite materials between the conductive envelop of the microwave device and the high-permeability pole pieces, with the microwave ferrite external to the conductive envelop having the same saturation magnetization as the microwave ferrite adjacent to it inside the conductive envelop. The resulting devices are similar to the broadband isolators shown in FIGS. 1–4C, except that they have three ports (rather than two) and no resistive sheet.

FIGS. 7A–7C illustrate such a circulator in a horizontal cross section (FIG. 7A), and two vertical cross sections (FIGS. 7B and 7C). The device contains four composite ferrite substrates 10, 11, 20 and 22, having a high-magnetization core regions 10*a*, 11*a*, 20*a* and 22*a* and a low-magnetization peripheral regions 10*b*, 11*b*, 20*b* and 22*b*. For the reasons described in connection with the broadband isolator the two saturation magnetizations should be approximately in the ratio of 2:1. The four composite substrates should be identical, except possibly for their thickness. They may be made by various techniques, including co-firing of the unfired ("green") starting materials. For the device shown in FIGS. 7A–7C the external shape of the substrates is hexagonal. The outer two composite ferrite substrates should have one surface completely metalized, to form the ground planes 14*a* and 14*b* of the transmission line structure. At least one of the inner substrates should have a metalization 44 that is patterned in the manner indicated in FIG. 7A, with the junction resonator having approximately the same diameter as the high-magnetization core region of the composite substrates, and positioned concentric with it. The junction resonator 44 is electrically connected to three strip conductors 12. The magnetic bias field for the device shown in FIGS. 7A–7C is supplied by three identical permanent magnets 28*a*, 28*b* and 28*c* located at the three corners. Alternatively, the permanent magnets can be replaced by posts of magnetically soft material, surrounded by current carrying coils. Only one of the three bias magnets shown in FIGS. 7A–7C is essential. However, the use of three symmetrically positioned magnets will improve field homogeneity, and hence device performance. The magnetic flux generated by the magnets or the coils goes through the pole pieces 24 and 26, the composite pole shoes 20 and 22, and the transmission line structure located between the two ground planes. The composite pole shoes 20 and 22comprise high-magnetization core regions 20*a* and 22*a*, and low-magnetization peripheral regions 20*b* and 22*b*.

Circulators of the type illustrated in FIGS. 7A–7C have the disadvantage that the magnetic bias field is influenced by the presence of magnetic materials in the vicinity of the device, especially if such materials become attracted by and attached to the bias magnet. A first preferred circulator embodiment of the invention that is not subject to this disadvantage is illustrated in FIGS. 8A, 8B and 8C, which represent cross sections of the same kind as FIGS. 7A, 7B and 7C. In this device the two bias magnets are in the interior of a shielded structure. High-permeability pole pieces 24 and 26 are positioned between the magnets 28*a* and 28*b* and the microwave device, immediately adjacent to microwave transmission line structure at a minimum separation from the magnetic material in the interior of this transmission line structure. The outer housing 30 of the device shown in FIGS. 8A–8C is comprised of top and bottom plates 30*a* and 30*b* and three triangular posts 30*c*, 30*d* and 30*e*. Only one of the two bias magnets 28*a* and 28*b* shown in FIGS. 8A–8C is essential. However, the use of two symmetrically positioned magnets will improve field homogeneity, and hence device performance.

In order to improve bias field homogeneity beyond the level achievable with the structure shown in FIGS. 8A–8C, two additional composite ferrite substrates consisting of the same high-and low-magnetization ferrites can be inserted between the transmission line structure of the circulator and the high-permeability pole pieces 24 and 26 shown in FIGS. 8A–8C. In this manner a more perfectly homogeneous bias field will be realized, albeit at the cost of higher manufacturing expenses. A circulator of this type is described in connection with FIGS. 9A–9C, which also incorporates another beneficial feature.

Figure 9A:
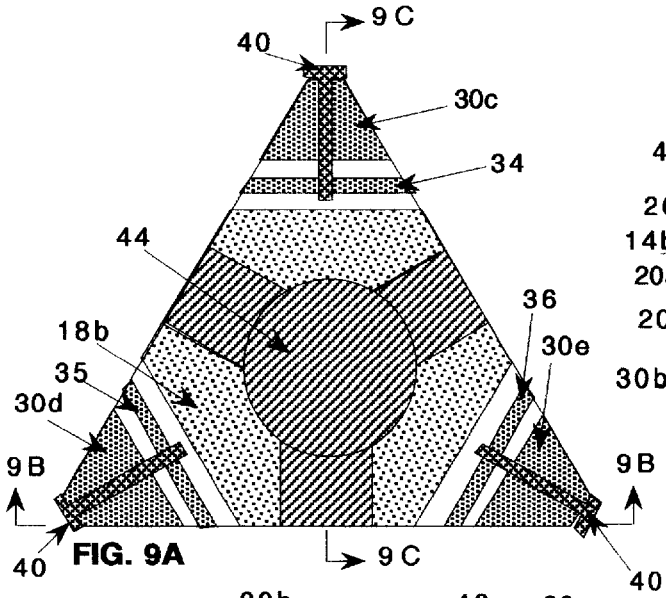
FIGS. 9A, 9B and 9C show three orthogonal cross sections through a third embodiment of a broadband circulator
Figure 9C:
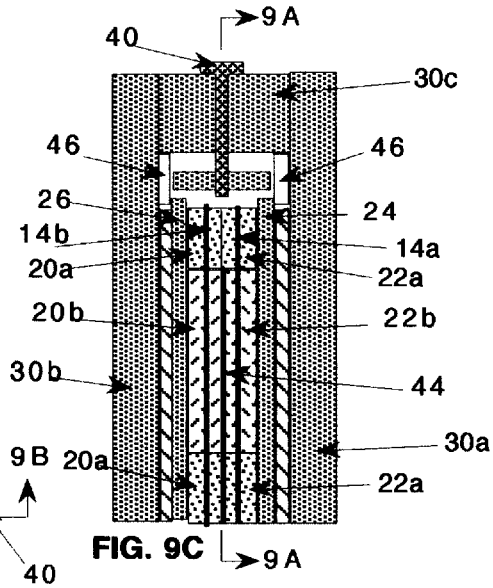
Figure 9B:
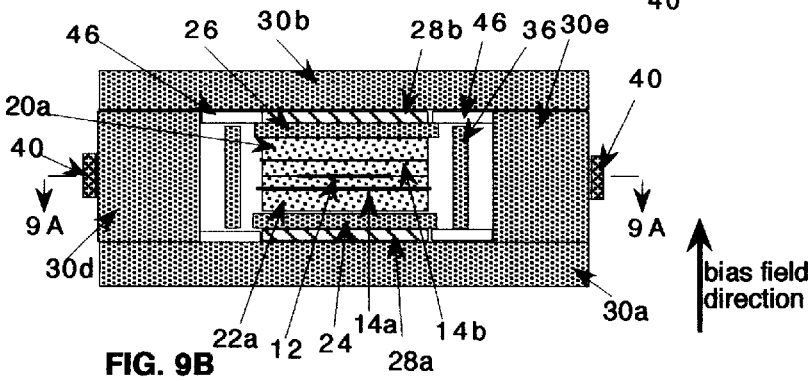

The theoretical analysis of stripline circulators indicates that the best broadband performance will be obtained at small bias field values. (This is also true for edge-mode isolators, as previously pointed out.) It is therefore advantageous to configure the circulator in such a manner that the bias field can be adjusted after the device has been fully assembled. A second preferred circulator embodiment of the invention, which incorporates this feature, is illustrated in FIGS. 9A, 9B and 9C. Tunability is achieved by incorporating three magnetic shunts 34, 35 and 36 in the bias structure. Each shunt is held in position by one or more tuning screws 40, rotatably mounted on one of the three corner posts 30*c*, 30*d* and 30*e* of the device. Each screw engages a thread in one of the magnetic shunts 34, 35 and 36. The bias field decreases when the shunts 34, 35 and 36 are moved closer to the pole pieces 24 and 26. If each shunt is held in position by a single tuning screw, magnetically inert spacers 46, having approximately the same thickness as the permanent magnet platelets 28*a* and 28*b*, may be positioned adjacent to them on the interior side of the base plate 30*a* and the top plate 30*b* of the circulator. Their purpose is to restrict rotation of the magnetic shunts 34, 35 and 36 around the tuning screws, while allowing motion in the direction of the axis of the screw. In order to achieve optimal field homogeneity, the circulator shown in FIGS. 9A–9C also incorporates composite pole shoes 20 and 22, which are positioned between the high-permeability pole pieces 24 and 26 and the ground planes of the transmission line structure. The composite pole shoes 20 and 22 comprise high-magnetization core regions 20*a* and 22*a*, and a low-magnetization peripheral regions 20*b* and 22*b*. The operation of the variable shunts in the circulator is substantially the same as discussed in connection with the isolator shown in FIGS. 7A–9C.

It is widely known that broadband circulators tend to be low-impedance devices, and this is also true for the circulators illustrated in FIGS. 7A–9C. In order to be useful in connection with transmission lines having a characteristic impedance of 50 Ohm, suitable broadband impedance transformers are required.

3. Isolators and Circulators for Balanced-Strip Transmission Line

Figure 10:
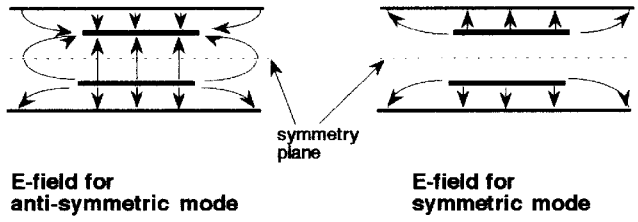
FIG. 10 illustrates the electric field pattern of the two dominant modes of balanced-strip transmission line.

In some applications of the broadband isolators and circulators described in this invention it may be advantageous to use the device in combination with a "balanced" transmission line. A balanced transmission line may be defined as a transmission line in which the total if ground plane current passing through any transverse cross section of the transmission line vanishes. This criterion is not satisfied by conventional stripline, because the total if ground-plane current is equal to the strip current (and opposite in polarity) and the strip current does not vanish. However, a balanced version of a stroline can readily be envisioned. A balanced-strip transmission line has two parallel ground planes and two strip conductors positioned symmetrically with respect to the central plane between the two ground planes, as illustrated in FIG. 10. When the "anti-symmetric mode" of this transmission line, the current on the two strip conductors are in phase opposition and the electric field pattern is as shown in the left diagram of FIG. 10. When the conductive boundaries are perfect conductors, this field pattern is exactly the same as for regular stripline, except that it is mirrored at the symmetry plane. A "symmetric mode" of wave propagation also exists for this transmission line. The electric field pattern for this mode, shown in the right diagram of FIG. 10, also has some similarity to the field pattern in conventional stripline, but does not match it completely.

Figure 11:
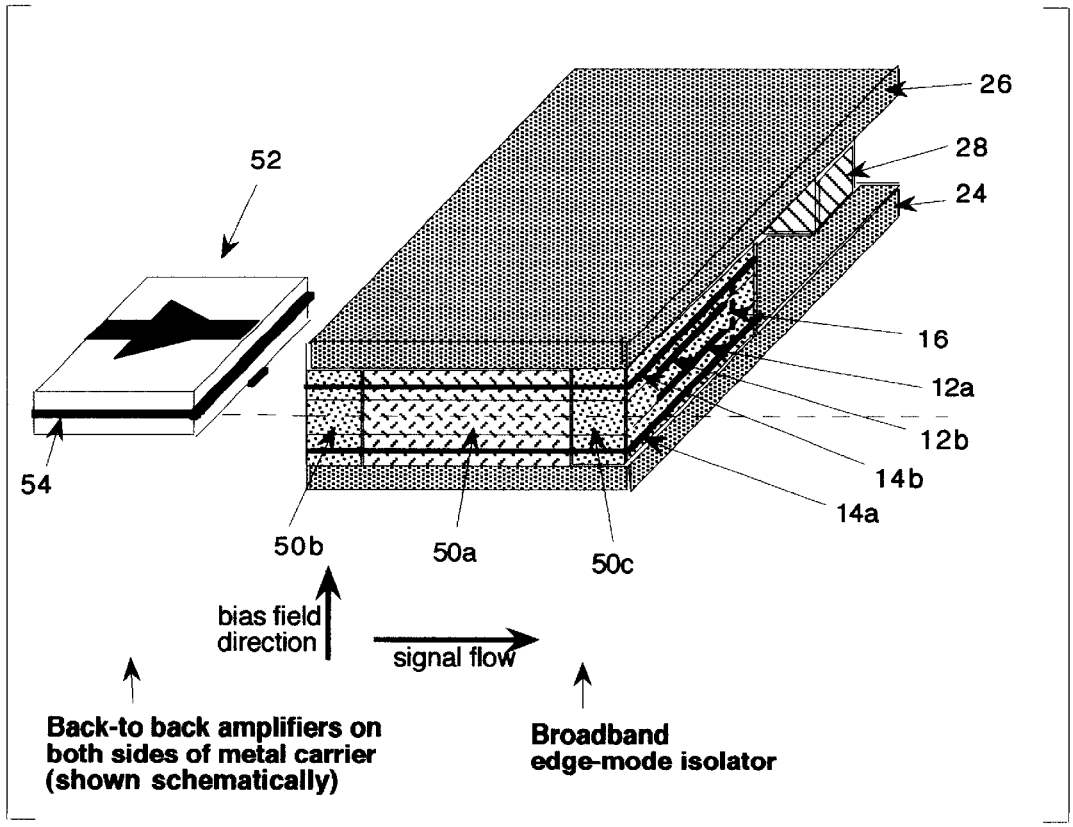
FIG. 11 shows a perspective view of a broadband edge-mode isolator for balanced-strip transmission line.

A broadband isolator for use with a balanced-strip transmission line is illustrated in FIG. 11 in an exploded view. Its structure is similar to the stripline isolator shown in FIGS. 1 and 1A, but the microwave transmission line now has two strip conductors 12*a* and 12*b* between its two ground planes 14*a* and 14*b*. Again the center section 50*a* contains a magnetic material with a relatively high saturation magnetization and the peripheral sections 50*b* and 50*c* contain a magnetic material with a relatively low saturation magnetization. For the device shown, three separate ferrite platelets are between the ground planes 14*a* and 14*b* of the device, and two of the platelets are between a ground plane and one of the high-permeability pole pieces 24 and 26. A resistive sheet 16 having a predetermined surface resistance is positioned along one side of the strip conductors 12*a* and 12*b*. For simplicity, this sheet is here shown as extending through the peripheral sections as well as the central section, in order to indicate its location in the structure. (In FIG. 1 it was shown as extending only through the central section, which may be preferable.) The isolator also comprises a source of magnetomotive force, here shown as a permanent magnet 28.

In FIG. 11 the input to the isolator for balanced-strip transmission line is shown schematically as being provided by two high-power amplifiers 52 that are placed back to back against a metal carrier 54, and are assumed to be driven by other devices in such a way that the anti-symmetric mode of wave propagation is excited. Alternatively, the two high-power amplifiers 54 could also be positioned side by side. In that case a suitable transition device must be inserted between the high-power amplifiers and the circulator. The output port of the isolator illustrated in FIG. 11 will usually be connected to the radiating elements of a microwave antenna.

Shielded versions of broadband isolators for balanced-strip transmission line can be constructed by modifying the designs illustrated in FIGS. 2A–4C in the same way as the design illustrated in FIGS. 1 and 1A was modified to alive at the design shown in FIG. 11 for an unshielded version. In other words, the interior of the transmission line structure will now contain three, rather than two ferrite platelets, and the single strip conductor is replaced by two strip conductors.

Similarly, broadband circulators for balanced-strip transmission line can be constructed by modifying the designs illustrated in FIGS. 7A–9C in the same way as the design illustrated in FIGS. 1 and 1A was modified to arrive at the design shown in FIG. 11. In this case, the interior of the transmission line structure will now contain three, rather than two composite ferrite substrates, and the single junction resonator with its connected strip conductors is replaced by two junction resonators with their connected strip conductors.

What I claim as my invention is:

1. A microwave isolator device comprising;

a microwave transmission line structure having an by two parts and including two thin metallic ground planes and two or more magnetic materials, disposed between the two thin metallic ground planes, with the thickness of the ground planes being a few times times the electromagnetic skin depth of the metal at the frequency of operation, in a manner such that microwave energy, on entering the device, passes through the magnetic materials having the lowest magnetization, and sequentially passes through magnetic materials having higher magnetizations, and, on emerging from the device, passes through the same sequence of magnetic materials in reverse order; and a magnetic biasing circuit disposed externally to the microwave transmission line structure and comprising high-permeability magnetic pole pieces arranged in a manner such as to provide a homogeneous magnetic bias field in the interior of the microwave transmission line structure.

2. A microwave isolator device comprising:

a microwave transmission line structure having only two ports and including two thin metallic ground planes and two or more magnetic materials, disposed between the two thin metallic ground planes with the thickness of the ground planes being a few times the electromagnetic skin depth of the metal at the frequency of operation, in a manner such that microwave energy, on entering the device, passes through the magnetic materials having the lowest magnetization, and sequentially passes through magnetic materials having higher magnetizations, and, on emerging from the device, sequentially passes through magnetic materials having lower magnetizations; and a magnetic biasing circuit disposed externally to the microwave transmission line structure and comprising:

high-permeability magnetic pole pieces placed adjacent to the microwave transmission line structure spaced from the magnetic material in the interior of this transmission line structure, and one or more sources of magnetomotive force.

3. A microwave device as recited in claim 2, in which the magnetic materials used in the transmission line structure of the device are ferrite materials.

4. A microwave device as recited in claim 2, in which the microwave transmission line structure is a microwave strip transmission line structure.

5. A microwave device as recited in claim 4, in which the magnetic materials used in the interior of the transmission line structure are ferrite materials.

6. A microwave device as recited in claim 4, that has a resistive layer with a predetermined surface resistance, disposed along the strip conductor, in an off-center position.

7. A two-port microwave device as recited in claim 6, in which the number of different magnetic materials used in the interior of the transmission line structure is two and the ratio of the saturation magnetizations of these materials is approximately 2:1.

8. A microwave isolator device comprising:

a microwave transmission line structure having only two ports and including two thin metallic ground planes and two or more magnetic materials, disposed between the two thin metallic ground planes with the thickness of the ground planes being a few times the electromagnetic skin depth of the metal at the frequency of operation, in a manner such that microwave energy, on entering the device, passes through the magnetic materials having the lowest magnetization, and sequentially passes through magnetic materials having higher magnetizations, and, on emerging from the device, passes through the same sequence of magnetic materials in reverse order; and a magnetic biasing circuit disposed externally to the microwave transmission line structure and comprising: composite magnetic pole shoes including, in the portion adjacent to the microwave transmission line structure, a sequence of individual magnetic pole shoes having a magnetization of the same magnitude as the magnetic material disposed adjacent to it in the interior of the microwave transmission line structure;

high-penneability magnetic pole pieces placed adjacent to the composite pole shoes at a minimum separation; and one or more sources of magnetomotive force.

9. A microwave device as recited in claim 8, in which the magnetic materials used in the transmission line structure of the device are ferrite materials.

10. A microwave device as recited in claim 8, in which the microwave transmission line structure is a microwave strip transmission line structure.

11. A microwave device as recited in claim 10, that has a resistive layer with a predetermined surface resistance, disposed along the strip conductor, in an off-center position.

12. A two-port microwave device as recited in claim 11, in which the number of different magnetic materials used in the interior of the transmission line structure is two and the ratio of the saturation magnetizations of these materials is approximately 2:1.

13. A microwave device as recited in claim 10, in which the magnetic materials used in the interior of the transmission line structure are ferrite materials.

* * * * *